US006310540B1

(12) United States Patent
Burnett et al.

(10) Patent No.: US 6,310,540 B1
(45) **Date of Patent: *Oct. 30, 2001**

(54) MULTIPLE SIGNAL AUDIBLE OSCILLATION GENERATOR

(75) Inventors: George A. Burnett, Coatesville; Robert L. Leonard, Jr., Indianapolis, both of IN (US)

(73) Assignee: Yosemite Investiment Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/768,758

(22) Filed: Dec. 17, 1996

(51) Int. Cl.[7] ..... G08B 3/10

(52) U.S. Cl. ..... 340/384.7; 340/384.6; 340/384.73; 340/384.1; 340/692

(58) Field of Search ..... 340/384.7, 384.6, 340/384.72, 384.73, 384.1, 384.4, 692; 331/116 M; 381/190, 116; 310/316, 318

(56) References Cited

U.S. PATENT DOCUMENTS

| | | | | |
|---|---|---|---|---|
| 3,638,223 | * | 1/1972 | Potter | 340/384.7 |
| 4,104,628 | * | 8/1978 | Sweany et al. | 340/384.7 |
| 4,180,808 | * | 12/1979 | Lebet et al. | 340/384.7 |
| 4,558,305 | * | 12/1985 | Black et al. | 340/384.7 |
| 4,626,799 | | 12/1986 | Matievic | 331/47 |
| 4,719,452 | * | 1/1988 | Logsdon | 340/384.7 |
| 5,163,447 | | 11/1992 | Lyons | 128/844 |
| 5,293,155 | | 3/1994 | Nicol et al. | 340/506 |
| 5,386,479 | | 1/1995 | Hersh | 381/190 |

OTHER PUBLICATIONS

Adel S. Sedra and Kenneth C. Smith, Microelectronic Circuits, Saunders College Publishing, 1991, pp. 653–658.

* cited by examiner

*Primary Examiner*—Daniel J. Wu
*Assistant Examiner*—Anh V. La
(74) *Attorney, Agent, or Firm*—Niro, Scavone, Haller & Niro

(57) ABSTRACT

A microcontroller is used to drive a piezoelectric transducer. Certain pins on the microcontroller are indicative of selection signals. The selector can be activated either by a user directly (e.g., by pushing buttons), by an offboard actuator (e.g., another microcontroller), or by any method known in the art for activating switches. In one embodiment, an output pin of the microcontroller acts as output for a high-low oscillator. The oscillation amplitude toggles between 0 and 5 volts in a square wave fashion. The output pin is coupled to the base of a bipolar junction transistor so that the transistor turns on and off as a switch in response to the high-low oscillations. As the transistor turns on and off, supply voltage is routed through a network of logic inverters, after first passing through a current limiting impedance means such as a resistor, to the piezoelectric transducer in a manner designed to provide a voltage swing at the transducer on the order of two times the supply voltage for each oscillation. In another embodiment, instead of using a single pin on the microcontroller to alternately forward and reverse bias a single transistor, the microcontroller actuates predetermined pins that are connected to different RC oscillators. The RC oscillators are then connected to the driving circuit. The circuit includes a voltage regulator connected at an input to the supply voltage and at an output to the power supply pin of the microcontroller.

11 Claims, 3 Drawing Sheets

MULTIPLE SIGNAL AUDIBLE OSCILLATION GENERATOR

BACKGROUND OF THE INVENTION

This invention relates to electronic sound generating devices. More specifically, the invention relates to circuits for controlling and driving such devices. Still more specifically, the invention relates to circuits for selecting the particular sounds to be generated by such sound generating devices.

Alarms and audible indicators have achieved widespread popularity in many applications. Of the countless examples available, just a few are sirens on emergency vehicles, in-home fire and carbon monoxide alarms, danger warnings on construction machines when the transmission is placed in reverse, factory floor danger warnings, automobile seat belt reminders, and many more. It is nearly a truism that industry prefers inexpensive but high quality devices to create such alarms and indicator sounds.

Piezoelectric transducers are sound producing electronic devices that are preferred by industry because they are by and large extremely inexpensive, reliable, durable, and versatile. This transducer has the unique property that it undergoes a reversible mechanical deformation on the application of an electrical potential across it. Conversely, it also generates an electrical potential upon mechanical deformation. These characteristics make it highly desirable for sound producing applications. When an oscillating potential is placed across the transducer, it vibrates at roughly the same frequency as the oscillations. These vibrations are transmitted to the ambient medium, such as air, to become sound waves. Piezoelectric transducers can also be coupled to a simple circuit in what is known as a feedback mode, well known in the art, in which there is an additional feedback terminal located on the element. In this mode, the crystal will oscillate at a natural, resonant frequency without the need for continuous applied driving oscillations. As long as the oscillations are in the range of audible sound, i.e., 20 to 20,000 Hertz, such oscillations can produce an alarm or an indicator.

Any periodic oscillation can be characterized by at least one amplitude and frequency. Ordinarily, the amplitude of oscillations of interest in a piezoelectric transducer application will be dictated by the voltage swing applied across the element. By the principles explained above, it is evident that there will be a greater mechanical deformation in the crystal with greater applied voltage. The effect is roughly linear within limits, those limits based in general on crystal composition and geometry. Thus, in the linear region, doubling the voltage swing doubles the mechanical deformation. Doubling the mechanical deformation increases the amplitude of vibrations transmitted into the ambient medium. Increased amplitude of vibrations in the medium causes an increased sound level, the relationship determinable by well known physical equations.

More specifically, when a piezoelectric element possesses two terminals and a driving oscillation is placed across one while the other is clamped to a common potential such as ground, the voltage swing will be at most the amplitude of the oscillations. Thus, if an oscillation of amplitude 5 volts is placed across one terminal, while the other is maintained at 0 volts, the maximum voltage swing will be 5 volts. This effectively caps the achievable decibel level of any sound to a value corresponding to the supply voltage. One could double the supply voltage to achieve double the voltage swing, but this has the disadvantage of added cost, and further is impractical when a piezoelectric audio circuit is to be placed in a unit having a standardized voltage supply such as an automobile. Alternatively, one could use a second supply disposed to provide the same oscillations but in a reversed polarity to double the effective voltage swing. But this approach possesses at least the same disadvantages.

It will be appreciated that when a piezoelectric element possesses two terminals and a driving oscillation is placed across one, and the identical driving oscillation is placed across the other but shifted 180 degrees in phase, the voltage swing will be at most two times the amplitude of the oscillations. Thus, if an oscillation of amplitude 5 volts is placed across one terminal while the other experiences the same oscillation but separated by 180 degrees of phase (half the period of the cycle), then the maximum voltage swing will be 10 volts. Higher sound pressures and louder tones are achievable with a voltage swing of 10 volts than with a voltage swing of 5 volts.

Particularly in alarm applications, what is needed is a loud sound that does not depend on the added circuit complexity of a doubled supply voltage or an additional reversed polarity supply. Loud sounds require relatively high voltages to produce relatively large amplitude vibrations in the transducer. In a special analog circuit, this might not be an obstacle. However, in a circuit containing elements that are safely and reliably operable only in a limited range of potentials, accommodations must be made to insure that those elements do not receive an electrical potential that is too high. Thus, in particular when a loud alarm sound is needed, care must be taken to separate the potentials driving the transducer from the potentials driving the more sensitive circuit elements. For example, integrated circuits often have specifications limiting the recommended power supply to 5 volts DC. If one desires to power a transducer using a supply voltage of 16 volts DC, care must be taken to regulate the power supplied to the integrated circuit.

In both alarm and indicator applications, what is needed is the ability to select different sounds to correspond to different situations. One might wish to distinguish, using discrete tones of differing frequencies, a carbon monoxide alarm from a smoke alarm while still allowing both to use-the same general circuit. In an additional example, one might wish to select one set of tones in an automobile indicator system to represent unfastened seat belts, and yet another set of tones to represent a door ajar, while still allowing both to use the same general circuit. Moreover, it is desirable for such a system to utilize a circuit that inexpensively enables loud sounds to be generated without the need for a doubled or duplicated supply voltage.

It is an object of the invention to provide a circuit for an audio transducer that enables different sounds to be generated that correspond to different operative situations.

Another object of the invention is inexpensively to enable loud sounds to be generated by an audio circuit that overcomes the foregoing disadvantages.

Still another object of the invention is to enable the use of voltage-sensitive components in the same circuit that contains an audio transducer that is disposed to receive large voltage swings.

SUMMARY OF THE INVENTION

The present invention attains these objects and others by including a driving circuit having an amplifier stage constructed of an array of logic gates, including at least one inverter, in a circuit containing a microcontroller programmed for different sounds. The amplifier stage enables a voltage swing of twice the supply voltage by ensuring two terminals oscillate 180° out of phase with each other. A microcontroller is used to drive a piezoelectric transducer. Certain pins on the microcontroller are indicative of selection signals. For example, three particular pins might comprise an 8 position selector (two to the third power). High or low signals (0 or 5 volts) on these pins select one of 8 musical note sequences stored in programmable memory inside the microcontroller. The selector can be activated either by a user directly (e.g., by pushing buttons), by an offboard actuator (e.g., another microcontroller), or by any method known in the art for activating switches. In one embodiment, an output pin of the microcontroller acts as output for a high-low oscillator. The oscillation amplitude toggles between 0 and 5 volts in a square wave fashion. The output pin is coupled to the base of a bipolar junction transistor so that the transistor turns on and off as a switch in response to the high-low oscillations. As the transistor turns on and off, supply voltage is routed through a network of logic inverters, after first passing through a current limiting impedance means such as a resistor, to the piezoelectric transducer in a manner designed to provide a voltage swing at the transducer on the order of two times the supply voltage for each oscillation. Thus voltage swing can be as high as twice the supply voltage. In another embodiment, instead of using a single pin on the microcontroller to alternately forward and reverse bias a single transistor, the microcontroller actuates predetermined pins that are connected to different RC oscillators. The RC oscillators are then connected to the driving circuit. Thus the sound producing electrical oscillations are generated external to the microcontroller. The circuit includes a voltage regulator connected at an input to the supply voltage and at an output to the power supply pin of the microcontroller. This insures that the driving potential for the microcontroller remains around 5 volts, the industry standard. The regulator can do this even up to supply voltages of about 35 volts. In consequence, the circuit can deliver a transducer voltage swing of about 70 volts (35 volts peak-to-peak, or about 25 volts RMS) resulting in a corresponding louder signal without causing damage to the microcontroller.

DESCRIPTION OF THE PREFERRED EMBODIMENTS

Figure 1:
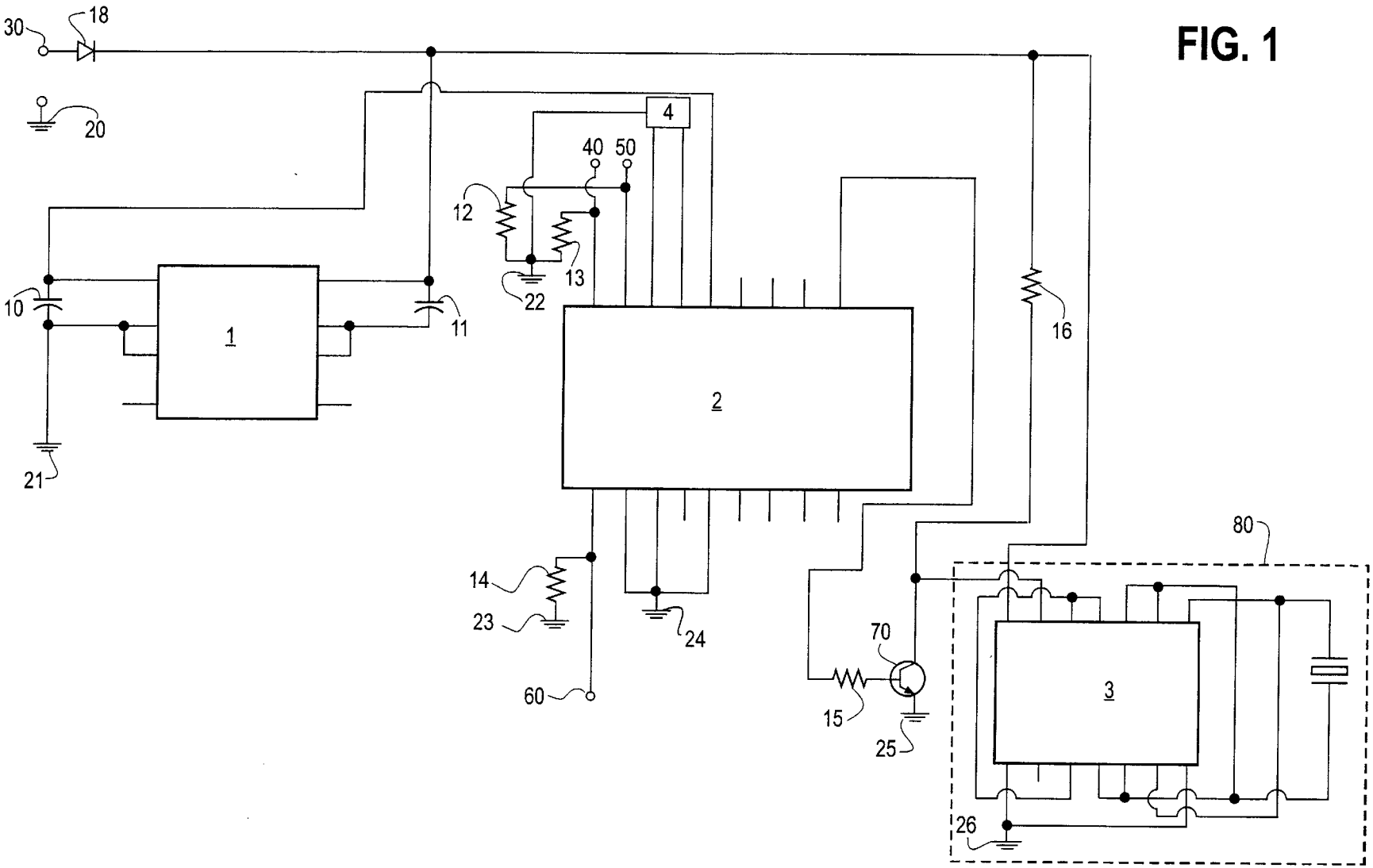
FIG. 1 is a detailed electric circuit diagram showing a preferred embodiment of a multiple signal audible ocillation generator according to the present invention.

Directing attention to FIG. 1, a detailed electric circuit diagram of a preferred embodiment of the invention is shown. This diagram shows a voltage regulator 1, a microcontroller 2, and a six input inverter logic array 3. In this preferred embodiment, regulator 1 is a MOTOROLA brand model MC78L05A8D regulator. Microcontroller 2 is a MICROCHIP brand PIC16C54A04I-50 microcontroller. Six input inverter logic array 3 is a NATIONAL SEMICONDUCTOR brand MM 74C14 M logic array. Although the MICROCHIP brand PIC15C64 is disclosed, no particular microcontroller brand is preferred. Likewise, many different brands of regulators and logic arrays will suffice to perform the functions outlined below.

Figure 2:
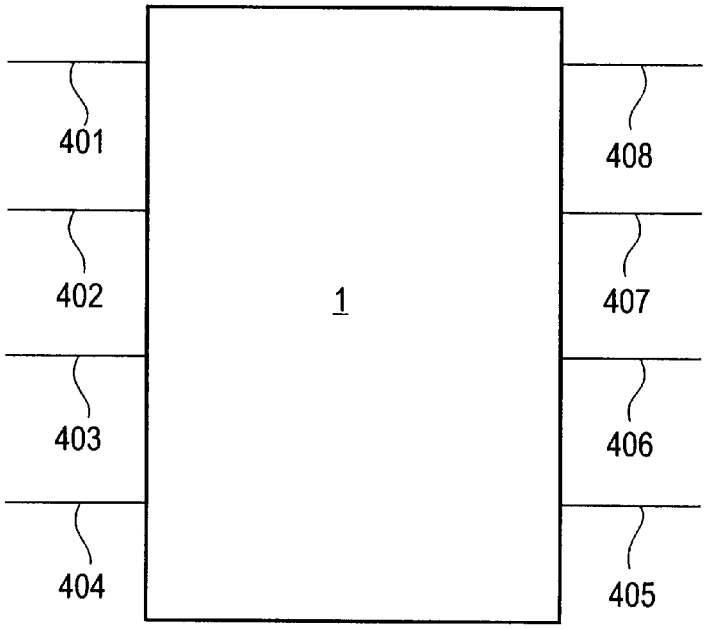
FIG. 2 is a diagram showing the pin configuration of a voltage regulator of one of the preferred embodinents.

Power enters the circuit through a power supply terminal 30. A power supply switch (not Docket No. 2292 shown) may be inserted between terminal 30 and ground 20 in any manner as is known in the art to control activation of the entire circuit. Diode 18 forward biases the current to prevent backflow into the power supply terminal. Drawing attention also to FIG. 2, which discloses the pin configuration of the voltage regulator, the power supply potential enters regulator 1 at pin 408. A predetermined maximum electrical potential, preferably 5 volts, appears at regulator 1 output pin 401. In automotive applications, the power is usually supplied through a potential of 12 volts, although there is no preferred supply voltage as long as it is between the regulator's predetermined maximum electrical output potential and the regulator's rated maximum, commonly around 35 volts. Pins 402, 403, 406 and 407 are ground pins, operatively coupled to ground 21. Capacitors 10 and 11 are blocking capacitors of preferably about one microfarad which enable transients to be grounded while maintaining uniform DC potential at pins 401 and 408, respectively. Pins 404 and 405 are not of interest for present purposes and are included for completeness.

Figure 3:
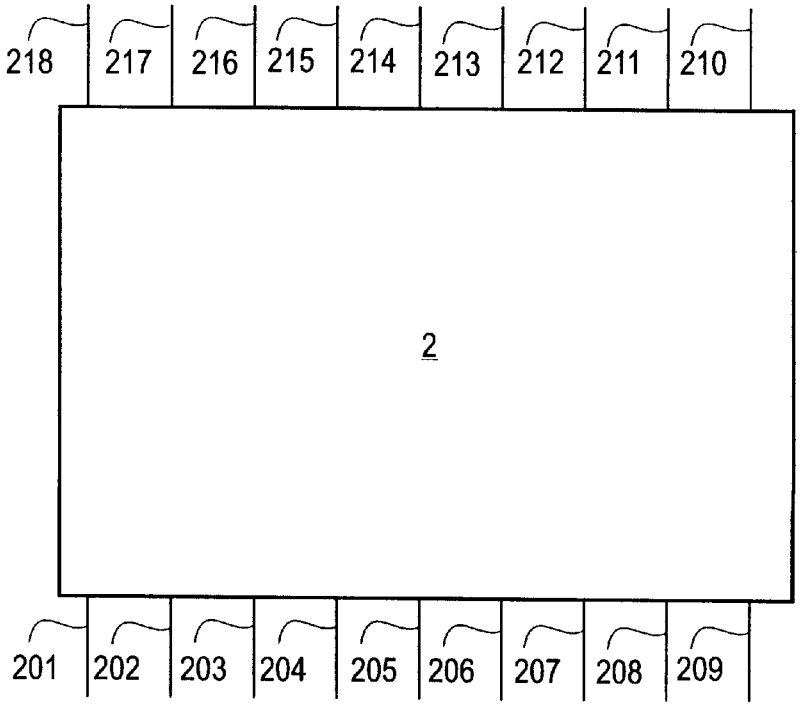
FIG. 3 is a diagram showing the pin configuration of an integrated circuit microcontroller of one of the preferred embodiments.

Drawing attention also now to FIG. 3, the regulator 1 output enters controller 2 at pin 214 to supply it with power. Pins 215 and 216 are coupled to crystal oscillator 4 to provide a clocking timer, preferably of a 4 megaHertz frequency. Crystal oscillator 4 is coupled to ground 22. Terminals 40, 50 and 60 are coupled to pins 218, 217 and 201 respectively. Resistors 12, 13 and 14 are current limiting resistors, preferably ten kilo-ohms, which are coupled to ground 22 or 23. Pins 202, 203 and 205 are coupled to ground 24. Pins 204, 206–209 and 211–213 are not of interest for present purposes and are included for completeness. Pin 210 is coupled to the base of bipolar junction transistor 70 through current limiting resistor 15, which is preferably 430 kilo-ohms. Transistor 70 has an emitter connected to ground 25 and a collector. The collector is coupled to terminal 30 through diode 18 and resistor 16, preferably 16 kilo-ohms.

Figure 4:
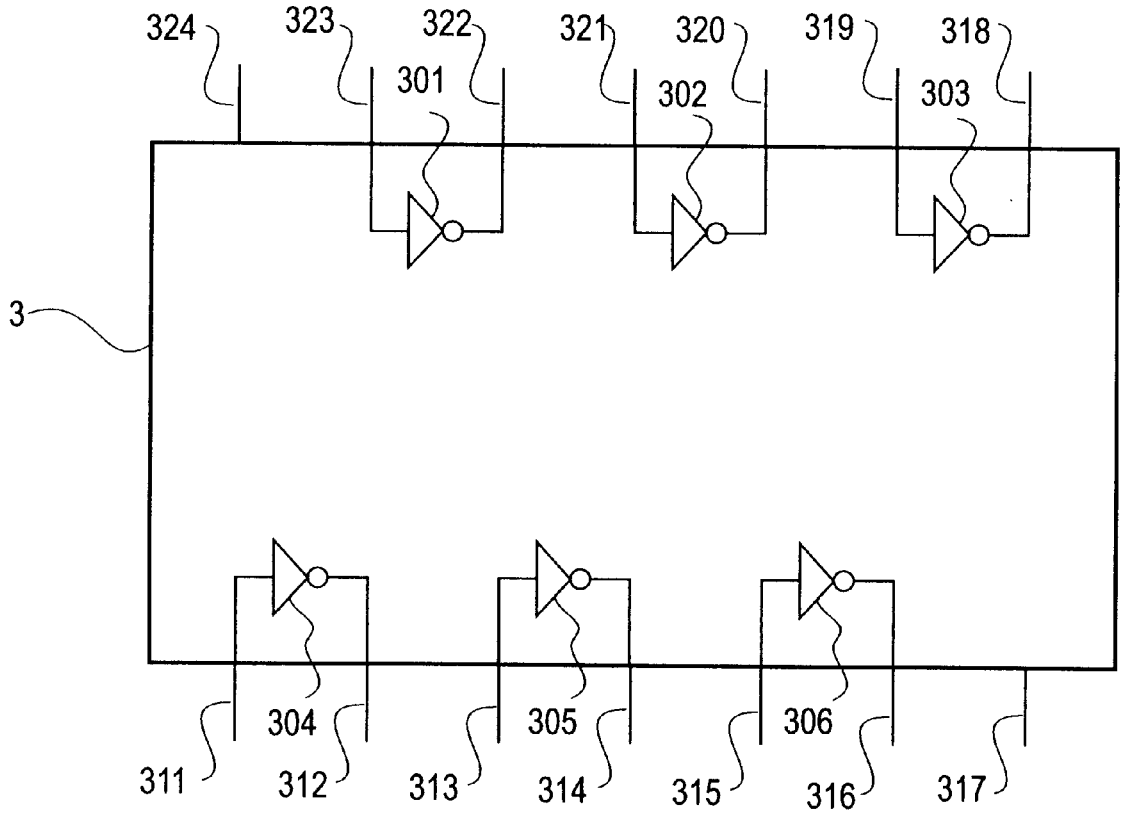
FIG. 4 is a diagram showing the pin configuration of a six input inverter logic array of the preferred embodiments.

The driving circuit 80 of this preferred embodiment will now be described. Focusing now also on FIG. 4, pin 324 of array 3 is connected to terminal 30 through diode 18. Pin 323 of array 3 is connected in parallel with collector of transistor 70 in the sense that it, too, is coupled to terminal 30 through diode 18 and resistor 16. Pins 322, 321 and 313 are coupled to each other. Pins 320, 319, 314 and 315 are coupled to each other and to one terminal of piezoelectric transducer 17. Piezoelectric transducer 17 can be of any variety. Typical ones contain a brass or stainless steel inner disk, and are rated for recommended maximum voltage supplies of 30 volts peak-to-peak (about 22 volts RMS). Pins 316 and 318 are coupled to each other and to the other terminal of piezoelectric transducer 17. Pins 317 and 311 are coupled to ground 26. Pin 312 is not of interest for present purposes and is included for completeness. As is shown in FIG. 4, array 3 consists of six single input single output inverters 301–306. Inverter 301 has an input coupled to pin 323 and an output coupled to pin 322. Inverter 302 has an input coupled to pin 321 and an output coupled to pin 320. Inverter 303 has an input coupled to pin 319 and an output coupled to pin 318. Inverter 304 has an input coupled to pin 311 and an output coupled to pin 312. Inverter 305 has an input coupled to pin 313 and an output coupled to pin 314. Inverter 306 has an input coupled to pin 315 and an output coupled to pin 316.

Microcontroller 2 is programmed to be selectively responsive to the plurality of pins coupled to inputs 40, 50 and 60, such that the occurrence of a sufficiently positive potential at any predetermined combination of them indicates any of a set of eight conditions. One of these eight conditions is a null condition, indicative of the absence of an activation instruction. Each of the seven non-null conditions causes the controller to address a predetermined portion of memory containing stored data indicative of a set of oscillation frequencies and of the sequence and duration to be applied to those oscillation frequencies. For illustration only, a high condition on terminal 40 and a low condition on terminal 50 and 60 might cause the controller to address a portion of memory containing the data indicative of the following: five cycles of a half second of a 1024 Hertz oscillations followed by a second of a 2048 Hertz oscillations. Any such sequences could take the form of musical notes to play a tune. Of course, the exact set of pins, the exact duration of each respective oscillation period, the exact frequency of respective oscillations, and the order in which they occur are well within the ability of a skilled programmer to control and adapt. Having addressed the location in memory containing such data, the controller actuates corresponding oscillations, of amplitude 5 volts, on an output pin 210.

When output pin 210 oscillates electrically between 0 and 5 volts, the potential likewise oscillates on the base of npn transistor 70. Since the emitter of transistor 70 is grounded by ground 25, and since the collector of transistor 70 is coupled to the supply potential through the power supply terminal 30, the oscillations on the base of transistor 70 toggle the transistor between forward and reverse bias. Recall that the collector of transistor 70 is coupled to pin 323. When transistor 70 is reverse biased, no current can flow from terminal 30 to ground 25 through the transistor; thus, the potential at pin 323 is the same as the supply potential (high). When transistor 70 is forward biased, current flows from terminal 30, through diode 18 and current limiting resistor 16, through transistor 70, and then to ground 25; thus, the potential at pin 323 is nearly ground (low). The low potential will actually not reach ground in this configuration due to the voltage drop across the semiconductor element, but this is not of concern because in any event the low potential will be much less than one volt.

Array 3 is directly powered through pin 324 by the supply potential. Inverter 301 inverts an incoming potential of pin 323. More specifically, when pin 323 is high, pin 322 is low. Likewise, when pin 323 is low, pin 322 his high. High potential on pin 322 is the supply potential. Since array 3 is directly grounded through pin 317, the aforementioned semiconductor voltage drop does not apply, and a low potential at pin 322 is nearly zero volts. Now the output of inverter 301 becomes the input of inverters 302 and 305. At this point, the outputs of inverters 302 and 305 are fed to one terminal of piezoelectric transducer 17 and simultaneously into the inputs of inverters 303 and 306. The outputs of inverters 303 and 306 are concurrently fed into another terminal of piezoelectric transducer 17.

In this way, when oscillations occur at pin 210, transistor 70 turns on and off at the same frequency, pin 323 goes low and high at the same frequency, and transducer 17 vibrates at the same frequency and with a voltage swing of twice the supply.

An alternate preferred embodiment will now be described. Focusing now on FIG. 2, instead of generating oscillations on pin 210, controller 2 can be programmed to generate a high potential state on pin 210 in response to the selective activation of a set of predetermined ones of terminals 40, 50 and 60, as described before. Along these lines, controller 2 is also programmed to generate a high potential state on pin 211 in response to the selective activation of a different set of predetermined ones of terminals 40, 50 and 60. Each of pins 210 and 211 is electrically coupled to the input of a different RC oscillator (not shown), external to controller 2. Frequency selection of an RC oscillator is well known in the art and is performed by simple adjustment of the values for R and C to achieve an acceptable time constant. Each RC oscillator also has an output. The respective RC oscillator outputs are electrically connected to pin 323. Thereby, when pin 210 exhibits a high potential state, one RC oscillator but not the other will output electrical oscillations into pin 323. When pin 211 exhibits a high potential state, the other RC oscillator will output electrical oscillations into pin 323. The driving circuit 80 in this embodiment functions the same way as described above, the difference being receipt of an input signal from an RC oscillator instead of from the collector of transistor 70.

It will be appreciated that those skilled in the art may now make many uses and modifications of the specific embodiments described without departing from the inventive concepts. For example, in the first preferred embodiment, transistor 70 functions as a switch, of which the art is replete with examples. For another example, a single pin on controller 2 may be used in the place of three pins to selectively activate the stored oscillation sequences, as it is well within the art to correspond an encoded sequence of high and low potentials on a single pin with a particular memory location in a microcontroller memory. For yet another example, while the driving circuit herein has been constructed of inverters, one could also use an arrangement of simple semiconductor devices to perform the same function. For still another example, in the alternate preferred embodiment, one can arrange a set of musical notes in a scale by the proper selection of component values corresponding to eight RC oscillators attached to eight microcontroller pins. Consequently, the invention is to be construed as embracing each and every novel feature and novel combination of features present in the multiple signal audible oscillation generator described.

What is claimed is:

1. A circuit for selectively generating electrical oscillations in the audible frequency range comprising means for providing a supply voltage;

a controller having a controller input and a controller output; and a driving circuit coupled to the controller output and operating in a manner to supply an amplitude of about twice the supply voltage;

the controller selectively responsive to a plurality of selection signals whereby upon receipt by the controller input of a predetermined one of the plurality of selection signals, the controller generates a corresponding sequence of electrical oscillations at the controller output, the oscillations essentially in the audible frequency range;

the driving circuit comprising first and second inverters each having a respective inverter input and inverter output;

a switch operatively coupled to the controller output and responsive to the oscillations thereupon to allow a high potential state to appear at the first inverter input during one of respective high and low phases of the oscillations and a low potential state to appear during the other of respective high and low phases of the oscillations;

the second inverter input electrically coupled to the first inverter output.

2. The circuit of claim 1 further comprising third, fourth and fifth inverters, each having an input and an output, wherein (a) the output of the first inverter is coupled to the input of the third inverter and the output of the third inverter is coupled to the input of the fourth inverter;

(b) the output of the second inverter is coupled to the input of the fifth inverter;

(c) the second and third inverters are cross-connected at their inputs and outputs; and (d) the fourth and fifth inverters are cross-connected at their outputs, whereby the outputs of the second and third inverters are inverted with respect to the outputs of the fourth and fifth inverters.

3. The circuit of claim 1 having a power supply terminal and a ground terminal, wherein the switch comprises a bipolar junction transistor having a base, a collector, and an emitter, the base operatively coupled to the controller output, the emitter operatively coupled to the ground terminal, and the collector operatively coupled to both the power supply terminal and the first inverter input, so that the transistor is forward biased during only one of respective high and low phases of the oscillations.

4. The circuit of claim 3 further comprising current limiting impedance means electrically coupled between the power supply terminal and the first inverter input.

5. The circuit of claim 1 comprising an audio transducer having first and second terminals, the first terminal electrically coupled to the first inverter output and the second terminal electrically coupled to the second inverter output.

6. The circuit of claim 5 wherein the audio transducer is a piezoelectric transducer.

7. The circuit of claim 6 wherein the piezoelectric transducer is arranged in a non-feedback configuration.

8. A circuit for selectively generating electrical oscillations in the audible frequency range comprising means for providing a supply voltage;

a controller having a controller input and a controller output;

at least one RC oscillator having an input electrically coupled to the controller output and tuned to a frequency essentially in the audible frequency range and having an output; and a driving circuit coupled to said at least one RC oscillator output and operating in a manner to supply an amplitude of about twice the supply voltage;

the controller selectively responsive to a plurality of selection signals whereby upon receipt by the controller input of a predetermined one of the plurality of selection signals, the controller generates an electrical potential at the controller output so that electrical oscillations are produced at the RC oscillator output;

the driving circuit comprising first and second inverters each having a respective inverter input and inverter output;

the plurality of RC oscillators operatively coupled to the first inverter input; and the second inverter input electrically coupled to the first inverter output.

9. The circuit of claim 8, the driving circuit including an audio transducer having first and second terminals, the first transducer terminal electrically coupled to the first inverter output and the second inverter terminal electrically coupled to the second inverter output.

10. A circuit for selectively generating electrical oscillations in the audible frequency range comprising a power supply terminal for providing a supply voltage;

a ground terminal;

a current limiting impedance means;

a controller having a controller input and a controller output, the controller selectively responsive to a plurality of selection signals whereby upon receipt by the controller input of a predetermined one of the plurality of selection signals, the controller generates a corresponding sequence of electrical oscillations at the controller output, the oscillations essentially in the audible frequency range;

a voltage regulator operatively coupled between the power supply terminal and the controller for limiting an electrical potential supplied to the controller;

a driving circuit coupled to the controller output and operating in a manner to supply an amplitude of about twice the supply voltage, the driving circuit comprising first and second inverters each having a respective inverter input and inverter output, the impedance means electrically coupled between the power supply terminal and the first inverter input, a bipolar junction transistor having a base, a collector, and an emitter, the base operatively coupled to the controller output, the emitter operatively coupled to the ground terminal, and the collector operatively coupled to both the power supply terminal and the first inverter input, the base responsive to the oscillations to forward bias the transistor during only one of respective high and low phases of the oscillations to allow a high potential state to appear at the first inverter input during a certain of respective high and low phases of the oscillations and a low potential state to appear during the other of respective high and low phases of the oscillations; and a piezoelectric audio transducer having first and second terminals, the first terminal electrically coupled to the first inverter output and the second terminal electrically coupled to the second inverter output.

11. A method for selectively generating sequences of loud sounds comprising the steps of:

generating a sequence indicator signal;

generating a sequence of electrical oscillations corresponding to the sequence indicator signal;

passing the sequence of electrical oscillations through a network of inverters having respective outputs so that the outputs of selected inverters within the network of inverters are continuously substantially 180 degrees out of phase with each other;

driving an audio transducer with the substantially 180 degrees out of phase outputs so that the audio transducer experiences a swing of twice the amplitude appearing at any one output.

* * * * *